United States Patent [19]

James

[11] Patent Number: 5,020,702

[45] Date of Patent: Jun. 4, 1991

[54] LIQUID POURING SPOUT

[76] Inventor: Jimmie J. James, 1 Woodland Ct., Novato, Calif. 94947

[21] Appl. No.: 354,394

[22] Filed: May 19, 1989

[51] Int. Cl.[5] ..... B67C 11/04

[52] U.S. Cl. ..... 222/529; 222/568; 222/1; 141/337

[58] Field of Search ..... 222/460, 461, 527, 529, 222/567; 141/337, 331, 334

[56] References Cited

U.S. PATENT DOCUMENTS

| | | | |
|---|---|---|---|
| 1,403,197 | 1/1922 | Rieck | 222/567 |
| 1,566,597 | 12/1925 | Harman | 222/527 |
| 2,545,350 | 3/1951 | Fuld | 222/567 |
| 2,556,627 | 6/1951 | Miksis | 222/568 |
| 2,858,050 | 10/1958 | Barnard | 141/331 |
| 4,534,483 | 8/1985 | Kassis et al. | 222/543 |
| 4,583,668 | 4/1986 | Maynard | 222/529 |
| 4,600,125 | 7/1986 | Maynard | 222/460 |
| 4,705,129 | 11/1987 | Krapton | 222/568 |
| 4,832,238 | 5/1989 | Taylor | 222/529 |

FOREIGN PATENT DOCUMENTS

| | | | |
|---|---|---|---|
| 618882 | 3/1927 | France | 222/529 |

*Primary Examiner*—H. Grant Skaggs

*Attorney, Agent, or Firm*—Thomas M. Freiburger

[57] ABSTRACT

A liquid pouring spout particularly for automotive fluids such as oil and antifreeze has provision for attachment to multiple container thread sizes, has a in-line valve for shutting off the flow of liquid adjacent to the inlet end of the device, and includes a removable cap for closing the downstream end of the pour spout, captively connected to the pour spout. The pour spout has a flexible portion for permitting bending as desired while pouring the liquids. With the valve and closure cap, the pour spout apparatus eliminates problems of dripping during or after use of the spout. The apparatus can include a funnel with a thread for connection to the pouring spout, for use with containers not having a compatible thread or in other situations where a funnel is desired.

8 Claims, 3 Drawing Sheets

LIQUID POURING SPOUT

BACKGROUND OF THE INVENTION

The invention relates to liquid dispensing devices, and more particularly to a pouring spout for connection to threaded-neck liquid containers to prevent leaking and dripping.

Pouring spouts for liquid dispensing containers are well known in various forms. See, for example, U.S. Pat. Nos. 1,287,046, 1,293,859, 1,597,782, 1,886,106, 3,282,478, 4,129,236 and 4,332,282. U.S. Pat. Nos. 3,282,478 and 4,129,236 show dispensing spouts having a captively connected removable and replaceable closure cap for closing an outer pouring end. U.S. Pat. Nos. 1,293,859, 1,886,106 and 4,332,282 show dispensers or spouts having an in-line valve for shutting off a flow of liquid through the dispenser. Other devices have included flexible bellows-type sections in pouring spouts, for permitting bending of the dispenser or spout while pouring liquids. Further spout constructions have included threaded couplings having provision for connection two or more sizes of male threads on a liquid container.

None of the prior liquid dispensing devices or pouring spouts has combined the features of the present invention described below, for maximum convenience and avoidance of drips and spills.

SUMMARY OF THE INVENTION

The liquid pouring device of the present invention has a number of features which enable versatility for use with the different liquid containers, convenience and ease of use, and prevention of messes from dripping or spilling during or after use of the pouring spout.

The pouring spout of the invention has at its upstream end a threaded coupling which is swivel-mounted, permitting rotation about the axis of the coupling. The coupling has at least two sizes of female threads, for attachment to at least two different types of container threads, providing an increased versatility of the pouring spout for a number of different liquid containers. With the swivel mounting, the threaded coupling can be screwed onto a container opening by rotation of the coupling without accompanying rotation of the body of the pouring spout.

The threaded coupling is connected to a valve body which preferably includes a spool type rotatable valve operable manually by a tab valve handle extending outwardly. The spool valve has a central bore which permits the passage of fluid when the tab handle is aligned with the flow direction, but shuts off flow when the handle and spool are turned to the perpendicular direction.

Downstream of the valve body is preferably included a flexible, bendable section, which may be of the well known bellows-type construction. The flexible portion terminates at a pouring end, which preferably is tapered in the downstream direction to a smaller-diameter outlet end.

At the outlet end is a closure cap which may be snapped or screwed onto the outlet end when desired, to prevent dripping after the pouring spout is used. The preferably screw- threaded cap has an integrally formed strap which is snapped onto the tapered end section, so that it is captively retained when the closure cap is not in position closing the end of the spout.

In use, the pouring spout of the invention is screwed onto a threaded neck of a liquid container, such as a plastic oil container, a transmission fluid bottle or an antifreeze container, using the swiveling threaded coupling at the upstream end of the pouring spout. Next, the closure cap may be unscrewed and removed from the end of the spout, and the pouring end is then inserted into the area where the dispensed liquid is to be received (such as an automobile radiator or oil fill opening). The flexible portion of the spout allows the spout to be angled as desired, such as when working in automobile engine areas with little clearance. With the container elevated, the valve is then opened manually, to dispense the liquid from the container through the pouring spout.

When the liquid has been dispensed as desired, the valve is closed, the pouring spout is pulled back and the closure cap is replaced to seal the end of the pouring spout. The threaded coupling is then removed by unscrewing it from the liquid storage container, to remove the pouring spout from the container.

When the pouring spout of the invention is used properly, dripping, spillage and messy use of a pour spout for liquids such as oils is easily avoided.

In one preferred embodiment the pouring spout is made up of a series of threaded parts that can be screwed together in different ways. Any of the valve, the adaptor sleeve, the flexible portion of the funnel can be eliminated.

It is therefore among the objects of the present invention to improve over prior pouring spouts, by including a number of features which prevent drips, spills and messy handling in the transfer of liquids, particularly automotive fluids, into a desired place. These and other objects, advantages and features of the invention will be apparent from the following description of a preferred embodiment, considered along with the accompanying drawings.

DESCRIPTION OF PREFERRED EMBODIMENTS

Figure 1:
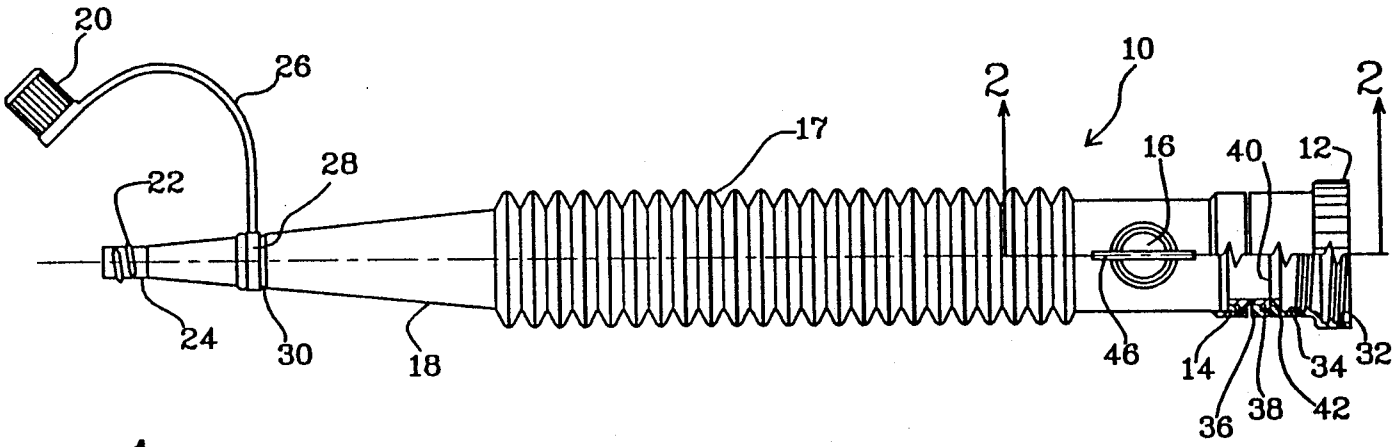
FIG. 1 is a partially sectioned plan or elevation view showing a pouring spout constructed in accordance with the principles of the present invention.

In the drawings, FIG. 1 shows a flexible pouring spout apparatus generally identified by the reference number 10. The pouring spout 10 of the invention is preferably constructed of molded plastic components. It includes a threaded coupling 12 at an upstream end, a valve body 14 with a valve 16 immediately downstream of the threaded coupling, a flexible section 17 which permits bending of the pouring spout in use, a preferably tapered pouring end 18 at the downstream end of the flexible section 17, and a downstream end closure cap 20.

The closure cap 20 is preferably screw threaded to mate with threads 22 at a downstream pouring tip 24 of the pouring spout. Also, the cap 20 is preferably integral with a retaining strap 26 which has a base end ring 28 snapped over an annular groove 30 in the tapered portion 18 of the pouring spout, as illustrated in FIG. 1.

As also shown in FIG. 1, the threaded coupling 12 preferably includes at least two different thread sizes, for increasing the universal use of the pouring spout for different containers. Thus, in FIG. 1 as illustrated an outer, larger female thread 32 and an inner, smaller-diameter female thread 34 are adjacent to one another. With these two threads appropriately selected, one size of pouring spout will fit a considerable number of different automotive liquid containers, such as those containing oil, transmission fluid and antifreeze. A third or even more sets of threads can be included if desired; however, it is preferable that the length of the assembly upstream of the valve 16 minimized in order to reduce to a minimum the surfaces to which liquids can cling upstream of the valve.

As illustrated, the threaded coupling 12 is secured to the valve 14 by a swivel connection. An inwardly extending annular flange 36 of the threaded coupling 12 is snapped over an outwardly extending flange 38 of the valve body (also shown in FIG. 2). These two flanges retain the two components together, and they are sealed along an interface line 40 by an O-ring 42 which may reside in an annular groove (not shown) in the threaded coupling 12 and presses against the upstream end of the valve body 14 when the components are together as shown in FIG. 1. The position of the O-ring 42 is shown in FIG. 2, but in FIG. 2 the threaded coupling has been removed.

Figure 2:
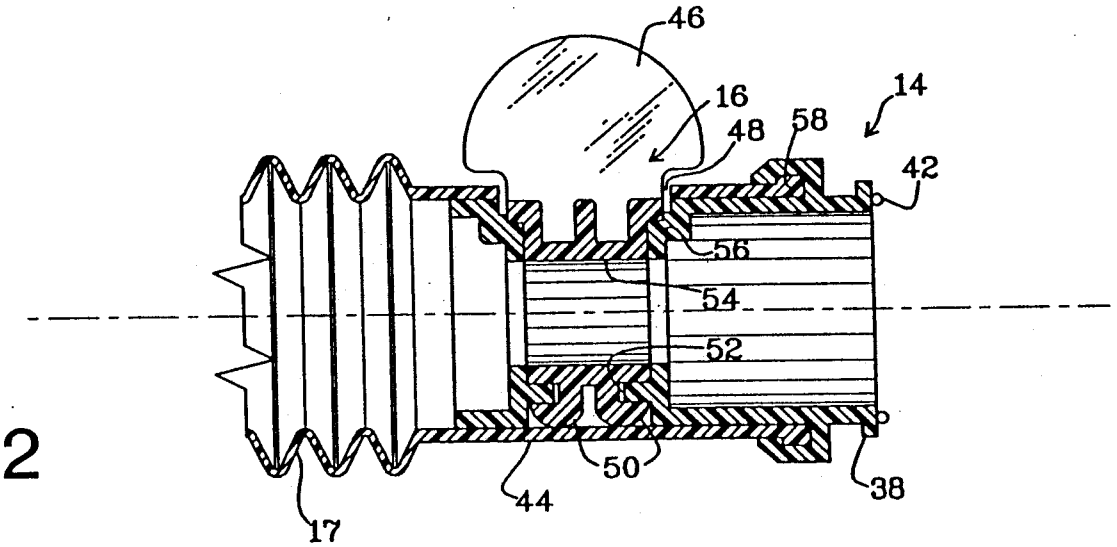
FIG. 2 is a sectional view of a portion of the pouring spout, showing particularly a valve included in the pouring spout, as seen generally along the line 2—2 in FIG. 1.

The valve body 14 is best seen in FIG. 2. It is slidingly received within a cylindrical portion 44 of the flexible section 17, preferably integral with the flexible section as illustrated in FIG. 2. The valve spool 16 itself is not inserted into the valve body until after the valve body has been inserted into the cylindrical section 44. The valve body 16, with a manual operating handle 46, may then be inserted down through a circular opening 48 through the cylindrical portion 44 to seat it in the valve body. The bottom end of the valve spool has retention members 50 which spread outwardly as shown in FIG. 2. These may be received through an opening 52 when the spool 16 is in a rotational position essentially at right angles to the position shown in FIG. 2. When the spool is first inserted, the retention members 50 are forced springingly inwardly to a slight extent in forcing them through the opening 52; thus, the valve spool 16 cannot later be removed from the valve body, even when the spool is in the valve-closed position.

As illustrated, the valve spool 16 is of typical construction, with a central fluid flow bore 54 which passes liquid when in a position illustrated in FIG. 2 (with the handle 46 aligned with the flow direction), but which will block the flow of fluid when turned to the right-angled position. An O-ring 56 seals the valve spool within the valve body, against leakage.

As also shown in FIG. 2, an O-ring 58 may be positioned between an upstream end of the cylindrical portion 44 and an annular surface of the valve body, to provide a seal between those components. In addition, the contacting interface between the inside surface of the cylindrical portion 44 and the exterior surface of the valve body may be permanently affixed together by a sealing cement.

The tapered pouring end section 18 of the pouring spout of the invention preferably is also integral with the bellows- type flexible section 17. This integral component may be formed by injection molding.

Figure 3:
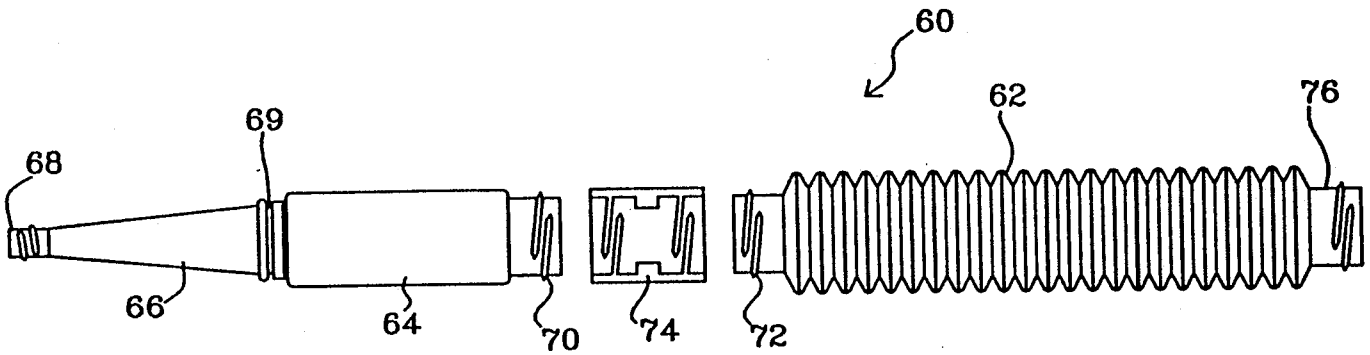
FIG. 3 is an exploded view, partially in section, showing major components of another preferred embodiment of a liquid pouring spout according to the invention.

FIG. 3 shows a portion of a second preferred embodiment of the invention 60, wherein all components have threads for connection together. FIG. 3 shows a bellows-type flexible pouring spout number 62 which is separate from a pouring end portion 64, which has a tapered end 66 terminating in a male-threaded tip 68. A closure cap 20 as in FIG. 1 (but not shown in FIG. 3) is provided to seal off the downstream end of the pourspout, preferably held captively by a narrowed diameter area 69, in the same manner as shown in FIG. 1. In this embodiment, the upstream end of the portion 64 has a male thread 70, and the downstream end of the bellows portion 62 has a similar male-threaded end 72. A coupling sleeve 74 between these two components has female threads at either end.

It should be understood that either the upstream end of the portion 64 or the downstream end of the bellows portion 62 could have a female thread for mating with a male thread of the other, eliminating the need for the separate coupling sleeve 74. However, the sleeve 74 gives versatility to the oil spout assembly of the invention, by enabling the flexible portion 62 and a valve to be eliminated, as further explained below.

The upstream end 76 of the bellows portion also has a male thread in this preferred embodiment, as illustrated in FIG. 3.

Figure 4:
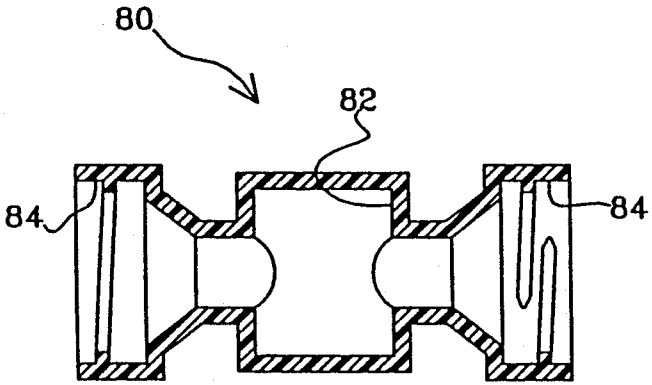
FIG. 4 is a sectional view of a valve body which forms a part of the embodiment of FIG. 3.

FIG. 4 shows a valve body 80 which may be used with this embodiment of the invention as shown in FIG. 3. The valve body 80 has a center valve socket 82 similar to what is shown in FIG. 2, for receipt of a similar spool-type valve member, not shown in FIG. 4. In this embodiment, both ends of the valve body 80 have female threads 84, for mating and assembly with the threaded upstream end of the bellows portion 62 (FIG. 3) and with a male thread 86 of a thread adaptor 88 shown in FIG. 5.

Figure 5:
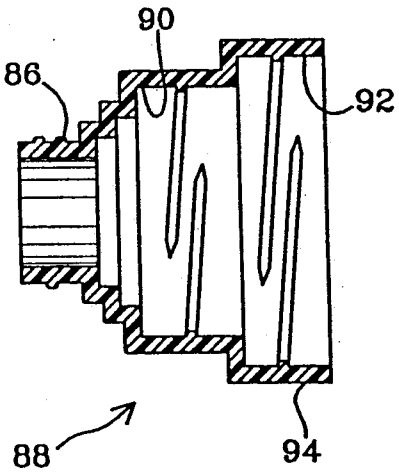
FIG. 5 is a sectional view of a thread adaptor which forms a part of the invention, particularly for the embodiments of FIGS. 3 and 4.

The thread adaptor 88 of FIG. 5 is similar to the adaptor or thread coupling 12 shown in FIG. 1, in having at least two different thread diameters 90 and 92 for receiving different male bottle neck threads. The difference of the coupler 88 from what is shown in FIG. 1 is that the coupler 88 screws into the valve body 80, rather than being snapped together with an O-ring seal as in FIG. 1.

The thread adaptor or coupler 88 can have a hexagonal outer configuration (e.g., the surface 94) if desired, for receiving a tool.

Figure 6:
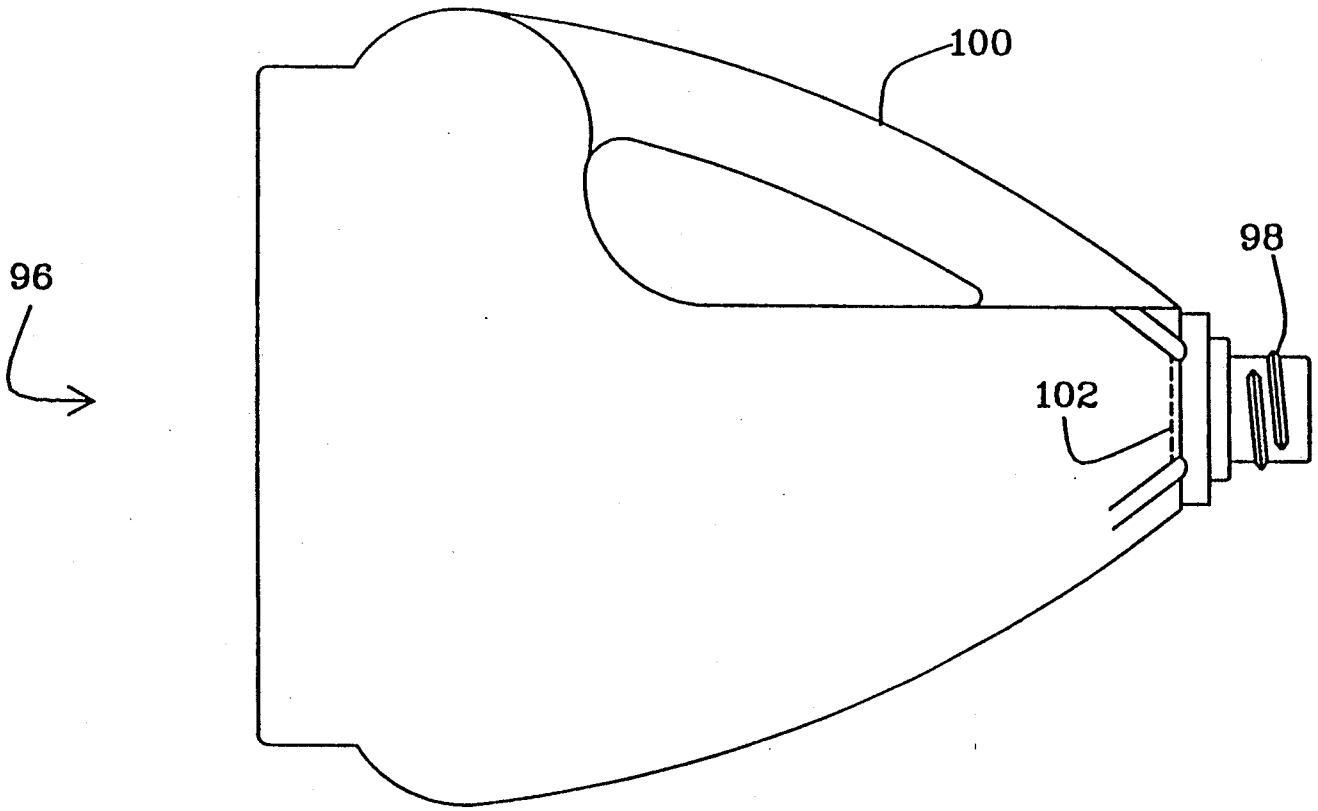
FIG. 6 is a view showing the exterior of a funnel which optionally can be used with and forms a part of the invention.

FIG. 6 is a view showing principally the exterior of a funnel 96, which may be used with either the embodiment shown in FIGS. 1 and 2 or the embodiment shown in FIGS. 3, 4, and 5. The funnel 96 can be attached to the thread coupling 88 (FIG. 5) via a male thread 98 at its pouring end. The purpose of the funnel is to enable pouring from a container into the pouring spout 60 of the invention in the event the container of liquid does not have a thread which can be directly connected into the thread coupling 88.

The funnel 96 may have a configuration generally as shown in FIG. 6 so as to provide a carrying or holding handle 100 on the funnel.

In a preferred embodiment, the funnel 96 includes an internal screen 102 secured on a ledge where the internal diameter narrows, as shown in the sectioned portion at the right of FIG. 6.

With this series of threaded, screw-together components, one or more of the components can be eliminated for certain situations if desired. For example the threaded sleeve 74 enables correction of the pouring end portion 64 directly to the funnel 96 or directly to a container having the same thread, or the spout 64 can be connected to a container via the thread adaptor 88. The valve 80 can be used to connect the end portion 64 to the funnel. Other assemblies can be made for situations where certain components are not needed or not desired (such as when a shorter overall length is needed).

With all of the features combined in the liquid dispensing spout of the present invention, dripping, spilling and messy use of a pouring spout are completely eliminated. The device is easily attached any of a number of containers, via the universal threaded coupling (which can be expanded to three or more increasing thread sizes). The flexible section permits dispensing liquids in tight places, and the valve and cap prevent dripping on initial pouring, during delivery of liquid and after liquid dispensing has been completed. Versatility is greatly enhanced by the series of threaded components of the embodiment just described.

The above described preferred embodiments are intended to illustrate the principles of the present invention, but not to limit its scope. Other embodiments and variations to these preferred embodiments will be apparent to those skilled in the art and may be made without departing from scope of the invention as defined by the following claims.

We claim:

1. A pouring spout for drip-free pouring of liquids from containers having threaded necks, comprising, a flexible generally tubular portion permitting bending of the pour spout, threaded coupling means at an upstream end of the pouring spout, for accommodating at least two different sizes of male threads on containers of liquids to be dispensed through the pouring spout, a valve connected between the flexible tubular portion and the threaded coupling means, the valve body including valve means for selectively passing liquid from the upstream end through the tubular portion or shutting off the flow of liquid, including a rotatable valve handle adapted for manual rotation to turn on or shut off liquid flow, a pouring end at the downstream end of the pouring spout, connected to the flexible tubular portion, and having means for receiving a closure cap, and a closure cap with means for securing in a leak proof manner to the pouring end of the pour spout, and including a flexible strap securing the closure cap to the pouring spout so as to captively hold the closure cap when it is not secured in closing relationship on the pouring end of the spout.

2. The pouring spout of claim 1, wherein the pouring end includes a male thread and the closure cap includes a complimentary thread, and wherein the retention strap has swivel connection means for enabling the strap to rotate around the pouring spout while the closure cap is being secured.

3. The pouring spout of claim 1, wherein the threaded coupling means includes swivel connection means permitting the threaded coupling to be rotated with respect to the remainder of the pouring spout while the threaded coupling is being secured to a container.

4. The pouring spout of claim 1, comprising a series of threaded sections which can be threadedly secured together, including a downstream end portion with said pouring end, a separate flexible tubular portion, a separate valve body with threads at either end, and said threaded coupling means comprising a coupler with at least two sizes of female threads for accommodating containers and threads at the other end for securing to the valve body.

5. The pouring spout of claim 4, wherein the flexible tubular portion has male threads at each end, the downstream end portion has a similar male thread at its upstream end and including a coupling sleeve with female threads at each end, said valve body having female threads at each end and the threaded coupling means comprising a separate coupling sleeve with a male thread at a downstream end for mating with any of said female threads.

6. The pouring spout of claim 1, further including a pouring funnel having a downstream end with thread means engageable with said coupling means at the upstream end of the pouring spout, so that containers not having a compatible male thread can be accomodated by using the funnel secured to the pouring spout.

7. The pouring spout of claim 6, wherein the funnel further includes handle means for enabling grasping of the funnel during use of the funnel and pouring spout.

8. The pouring spout of claim 6, wherein the funnel further includes an internal screen for filtering foreign material from the liquid being dispensed.

* * * * *